US005200759A

United States Patent [19]

McGinnis

[11] Patent Number: 5,200,759

[45] Date of Patent: Apr. 6, 1993

[54] TELECOMMUNICATIONS TOWER EQUIPMENT HOUSING

[76] Inventor: Henry J. McGinnis, 132 Los Robles Dr., Arlington, Tex. 76006

[21] Appl. No.: 709,633

[22] Filed: Jun. 3, 1991

[51] Int. Cl.[5] ..... H01Q 1/12

[52] U.S. Cl. ..... 343/890; 343/872; 52/111

[58] Field of Search ..... 343/890, 891, 872, 878, 343/879; 52/111, 121, 114

[56] References Cited

U.S. PATENT DOCUMENTS

| | | | |
|---|---|---|---|
| 2,164,427 | 7/1939 | Rhodes | 52/649 |
| 2,508,084 | 5/1950 | Alford | 343/890 |
| 2,731,055 | 1/1956 | Smith | 343/872 |
| 2,778,014 | 1/1957 | Rowland | 343/890 |
| 3,125,189 | 3/1964 | Graham | 52/65 |
| 3,303,506 | 2/1967 | Diebold | 343/872 |
| 3,388,512 | 4/1968 | Newman | 52/64 |
| 3,427,627 | 2/1969 | Losee | 343/872 |
| 3,605,105 | 9/1971 | Penzias | 343/890 |
| 3,768,016 | 10/1973 | Townsend et al. | 343/879 |
| 4,209,789 | 6/1980 | Snedkerud | 343/765 |

*Primary Examiner*—Rolf Hille
*Assistant Examiner*—Hoanganh Le
*Attorney, Agent, or Firm*—James E. Bradely

[57] ABSTRACT

A facility for transmitting telecommunication signals from a tower utilizes an annular housing mounted to the tower. The housing has a central opening through which the tower extends. The housing has a circular wall with an axis that coincides with the longitudinal axis of the tower. Antennas and transmitters are mounted within the housing.

11 Claims, 2 Drawing Sheets

TELECOMMUNICATIONS TOWER EQUIPMENT HOUSING

BACKGROUND OF THE INVENTION

1. Field of the invention

This invention relates in general to telecommunication towers, and in particular to a housing for mounting to a tower at an elevated location for containing the telecommunications equipment.

2. Description of the Prior Art

Telecommunication towers of the type concerned herein are tall steel structures, normally at least several hundred feet high. Typically a single tower will contain a number of different telecommunication antennas. These may include radio, television and microwave antennas. The antennas often are of a variety of types and shapes. It is common for users to rent space on a tower to support an antenna.

The equipment for use with each antenna is normally located in a building at the base of the tower. This equipment may include a transformer for transforming utility line high voltage. The equipment also includes transmitters and receivers. Several transmitter/receivers may be connected to each antenna. A transmission line consisting of a co-axial cable or wave guide will extend from each transmitter/receiver to the antennas. Electronic signals for transmission and reception on the antennas will be transferred through the transmission line to the antennas.

One disadvantage is that the transmission lines are expensive. Also, depending on the number of antennas, a large number of transmission lines may be required. This increases load on the tower. The antennas are exposed to the weather and create considerable wind resistance depending on their shape. The ability of the tower to withstand wind load limits the number of antennas that can be placed on the tower. Ice forming on the antennas can substantially increase the load on the tower.

SUMMARY OF THE INVENTION

In this invention, a housing is mounted to the tower at a selected elevation above ground. The housing is annular, having a central opening through which the tower extends. The tower has an outer wall that is circular and made of a non-metallic material.

A plurality of antennas are mounted inside the housing. Each directional antenna faces outward toward the outer wall for transmitting signals. Transmitter/receivers and other telecommunications equipment will also be located in the housing.

DETAILED DESCRIPTION OF THE INVENTION

Figure 1:
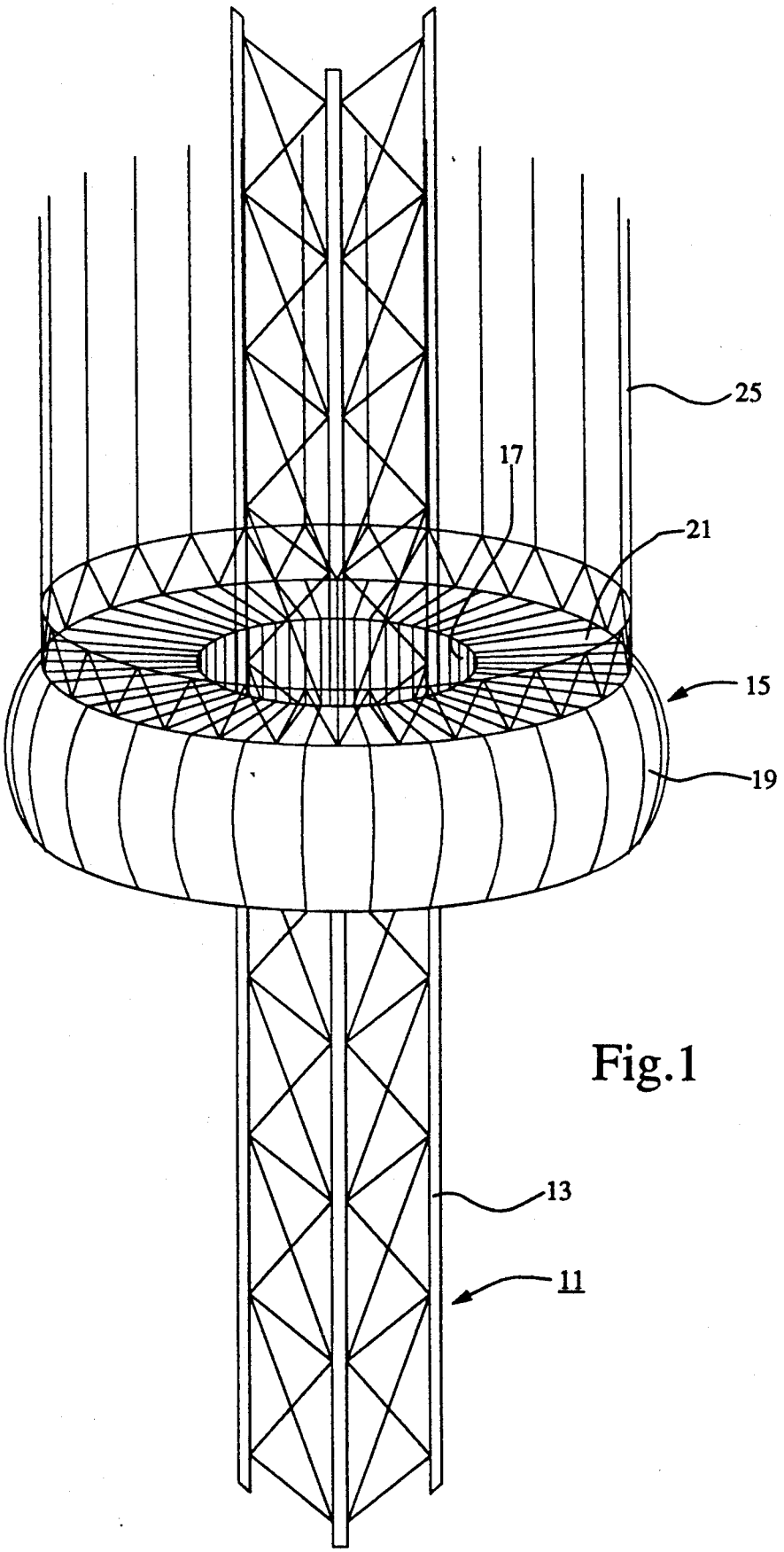
FIG. 1 is a perspective view illustrating portions of a tower having a telecommunications housing constructed in accordance with this invention.

Referring to FIG. 1, tower 11 may be a conventional telecommunications tower. Tower 11 may be of a guy wire type as shown, or it may be self supporting. Tower 11 will normally have at least three vertical leg members 13. The tower 11 has a longitudinal axis that is equidistant between the leg members 13.

A telecommunications housing 15 encircles the tower 11 and is mounted to the tower 11 at a desired elevation above ground. It can be mounted at the top, or at any point below. Furthermore, more than one housing 15 may be mounted on a tower 11. Housing 15 has an inner wall 17 that is circular in the embodiment shown. The inner wall 17 has a longitudinal axis that coincides with the axis of the tower 11 and defines an opening through which the tower 11 passes. Inner wall 17 is made up of a plurality of panels or sections secured together to form a solid wall. The housing 15 mounts to the leg members 13 at the inner wall 17. Horizontal metal grating (not shown) may be located within the opening of inner wall 17 between the leg members 13 for supporting equipment outside of housing 15.

Housing 15 also has a circular outer wall 19. Outer wall 19 has an axis that coincides with the longitudinal axis of tower 11. Outer wall 19 has a greater diameter than inner wall 17 and is of a nonmetallic material, such as fiberglass. A top 21 joins the inner and outer walls 17, 19 at the upper ends. Housing 15 also has a bottom or a floor 23, illustrated in FIGS. 2 and 3. Floor 23 joins inner and outer walls 17, 19 on the lower ends. Housing 15 thus defines an annular enclosure.

Figure 2:
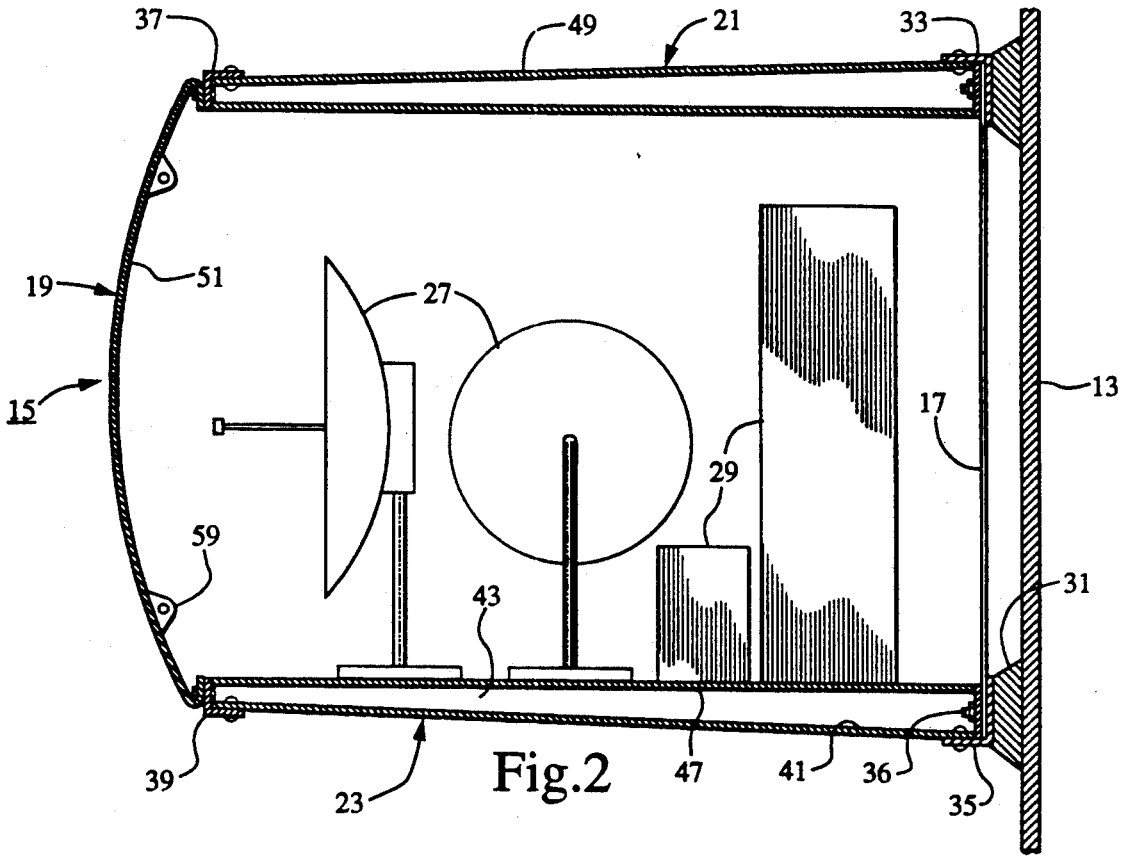
FIG. 2 is a vertical sectional view of a portion of the housing of FIG. 1.

A plurality of rod shaped antennas 25 will be mounted to the exterior of housing 15. Antennas 25 are shown extending upward from top 21. Although not shown, a number of rod shaped antennas could also be mounted to the bottom of housing 15, extending downward from housing 15. The downward extending antennas could be mounted to holes in the floor 23. As shown in FIG. 2, a plurality of antennas 27 may be mounted to the floor 23 in the interior of housing 15. Some of the antennas 27 will likely be directionally oriented, such as the dish-shaped microwave antennas shown. Each of the antennas 27 that are directional will face outward toward the outer wall 19.

The nonmetallic material of outer wall 19 freely allows the passage of electronic signals being transmitted to and from antennas 27. A plurality of transmitters 29, which may also include receivers, will be located in housing 15 close to the antennas 27. The lengths of the transmission lines needed between transmitters 29 and antennas 27 are thus very short. A high voltage transformer (not shown) may be mounted on a floor grate within the central opening defined by inner wall 17 for transforming high voltage from utility lines to the required voltage for the transmitters 29 located in the housing 15.

Referring still to FIG. 2, the mounting means for mounting the housing 15 to the tower 11 includes spaced apart brackets 31 secured to the leg members 13. Housing 15 has a circular upper inner ring 33 that surrounds the tower 11 and defines the upper edge of inner wall 17. Housing 15 also has a circular lower inner ring 35 that defines the lower edge of the inner wall 17. Inner rings 33, 35 are circular in the embodiment shown and are of the same diameter. In transverse cross-section, the upper and lower inner rings 33, 35 are in the shape of an angle, each having a vertical flange and a horizontal flange intersecting each other at a 90 degree angle. The upper and lower inner rings 33, 35 are fastened to the brackets 31 by bolts 36.

Housing 15 also includes upper and lower outer rings 37, 39. The outer rings 37, 39 are spaced vertically apart and are circular. The outer rings 37, 39 are the same diameter, each being greater in diameter than the inner rings 33, 35. The outer rings 37, 39 in transverse cross-section also are in the shape of an angle, each having a vertical flange and a horizontal flange.

Floor 23 is made up of a plurality of floor sections 41. Each floor section 41 includes a flat plate, with an inner edge secured to the lower inner ring 35. Each floor section 41 has an outer edge secured to the lower outer ring 39. The floor sections 41 have on each side edge a floor flange 43. The flanges 43 are integrally formed with floor section 41 and are of sheet metal. Each flange 43 is located on a radial line of the axis of the lower inner ring 35. As a result, each lower section 41 increases in circumferential width in a pie-shaped fashion moving from the lower inner ring 35 to the lower outer ring 39.

Figure 3:
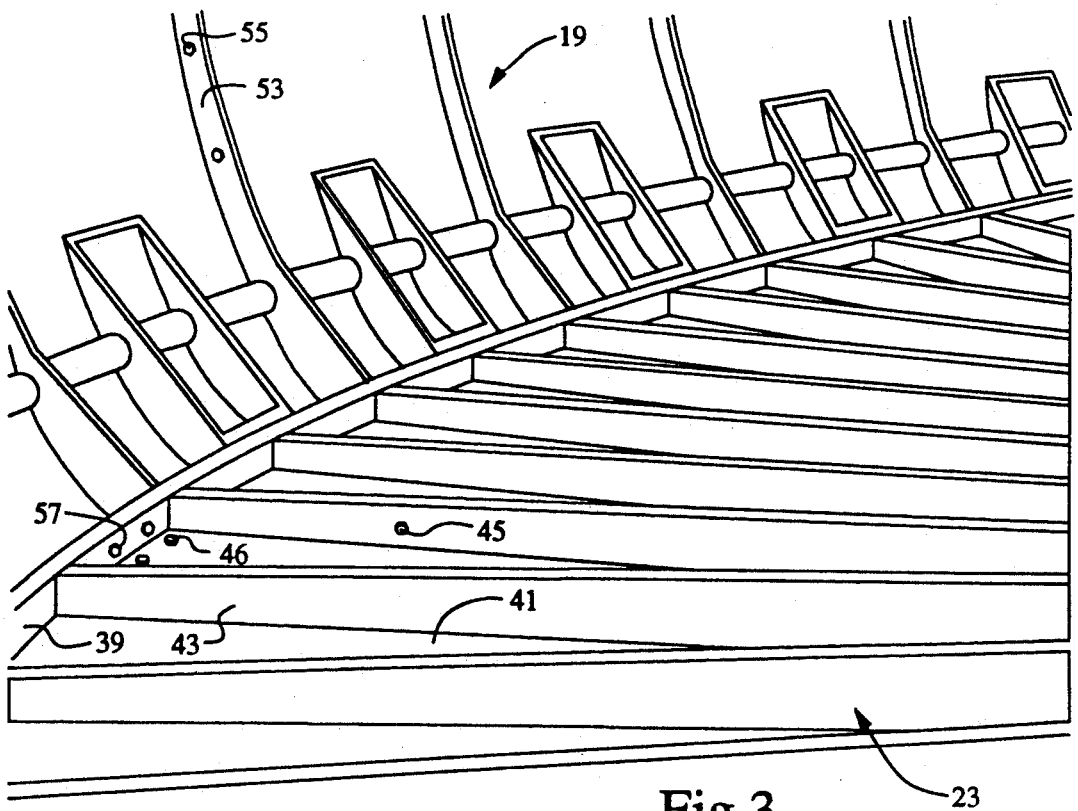
FIG. 3 is a perspective view illustrating a portion of the interior side of the outer wall and floor structure of the housing of FIG. 1, and shown with the floorboards removed.

Each floor flange 43 extends upward from the floor section 41 into the interior of housing 15. The floor flanges 43 are bolted to each other with fasteners 45. The outer edges of the floor sections 41 are bolted to the lower outer ring 39 with fasteners 46. For clarity, only one set of fasteners 45, 46 are shown in FIG. 3, although each of the floor sections 41 and floor flanges 43 would have similar sets of fasteners 45, 46.

As shown in FIG. 2, the upper edges of the floor flanges 43 are located in a plane perpendicular to the longitudinal axis of tower 11. The flanges 43 increase in vertical dimension from the lower outer ring 39 to the lower inner ring 35. The plate of each floor section 41 between flanges 43 inclines downward from the outer edge to the inner edge. Floor boards 47 (shown only in FIG. 2), preferably of plywood, will be placed on top of the floor flanges 43. The floor boards 47 support the antennas 27 and transmitters 29, as well as providing means for personnel to move about the housing 15.

Top sections 49 are identical to the floor sections 41, but inverted during installation. Top sections 49 join the upper outer ring 37 to the upper inner ring 33. The lower surface of the assembled top sections 49 is perpendicular to the longitudinal axis of tower 11.

A plurality of outer wall sections 51 join together to make up the outer wall 19. The outer wall sections 51 are curved outward as illustrated in FIG. 2. This enhances the aerodynamic features of housing 15. The outer wall sections 51 have vertical side edges, each containing an integral wall flange 53. As shown in FIG. 3, the wall flanges 53 are located on the interior of outer wall 19 and are joined together by fasteners 55 (only two shown). Fasteners 57 (only two shown) secure the lower edges of the outer wall sections 51 to the lower outer ring 39. Similar fasteners secure the upper edges of the outer wall sections 51 to the upper outer ring 37.

Each wall section 51 has two vertically spaced apart stiffener rib 59 segments molded to its interior surface. The segments of each stiffener rib 59 join each other to provide a continuous, circumferential rib extending on the interior of outer wall 19.

In operation, housing 15 may be installed on existing towers 11 or on new towers 11. Transmitters 29 and antennas 27 are located within housing 15. Antennas 25 (FIG. 1) may also be located on the exterior. An elevator (not shown) may be used to deliver personnel from the ground to and from the housing 15.

The invention has significant advantages. The aerodynamic contour of the housing reduces wind load for towers carrying a number of antennas. The housing contains transmitters and other equipment, positioning them much closer to the antennas than in the prior art. This reduces the length of transmission line required. This also reduces weight and wind load on the tower. The antennas are shielded from being coated with ice, which otherwise would increase load. The housing may be heated to prevent ice from coating on its exterior.

While the invention has been shown in only one of its forms, it should be apparent to those skilled in the art that it is not so limited, but is susceptible to various changes without departing from the scope of the invention.

I claim:

1. A housing for a tower for housing telecommunication equipment, comprising in combination:

an annular outer wall having an axis adapted to coincide with a longitudinal axis of the tower, the outer wall being of a material selected to allow the passage of telecommunication signals through the wall from the telecommunication equipment;

an annular inner wall spaced radially inward from the outer wall, the inner wall defining a central opening for receiving the tower;

a floor extending between the inner and outer walls for supporting the telecommunication equipment;

a top extending between the inner and outer walls above the floor;

means at the inner wall for securing the housing to the tower; and wherein the outer wall comprises a plurality of separate wall sections, each wall section having a vertical inward extending flange on each side, the flanges being fastened together.

2. A housing for a tower for housing telecommunication equipment, comprising in combination:

an annular outer wall having an axis adapted to coincide with a longitudinal axis of the tower, the outer wall being of a material selected to allow the passage of telecommunication signals through the wall from the telecommunication equipment;

an annular inner wall spaced radially inward from the outer wall, the inner wall defining a central opening for receiving the tower;

a floor extending between the inner and outer walls for supporting the telecommunication equipment;

a top extending between the inner and outer walls above the floor;

means at the inner wall for securing the housing to the tower; and wherein the outer wall comprises:

a plurality of wall sections extending circumferentially around the outer wall, each wall section having a vertical inward extending flange on each side edge; and a plurality of fasteners securing the flanges together.

3. A housing for a tower for housing telecommunication equipment, comprising in combination:

an annular outer wall having an axis adapted to coincide with a longitudinal axis of the tower, the outer wall being of a material selected to allow the passage of telecommunication signals through the wall from the telecommunication equipment;

an annular inner wall spaced radially inward from the outer wall, the inner wall defining a central opening for receiving the tower;

a floor extending between the inner and outer walls for supporting the telecommunication equipment;

a top extending between the inner and outer walls above the floor;

means at the inner wall for securing the housing to the tower; and wherein the floor comprises:

a plurality of floor sections extending circumferentially around the housing, each floor section having a vertical flange on each side edge, the flanges of the floor sections being fastened together, the floor sections having outer edges that join a lower edge of the outer wall, the floor sections having inner edges that join a lower edge of the inner wall.

4. A housing for a tower for housing telecommunication equipment, comprising in combination:

an annular outer wall having an axis adapted to coincide with a longitudinal axis of the tower, the outer wall being of a material selected to allow the passage of telecommunication signals through the wall from the telecommunication equipment;

an annular inner wall spaced radially inward from the outer wall, the inner wall defining a central opening for receiving the tower;

a floor extending between the inner and outer walls for supporting the telecommunication equipment;

a top extending between the inner and outer walls above the floor;

means at the inner wall for securing the housing to the tower; wherein the floor comprises:

a plurality of floor sections extending circumferentially around the housing, each floor section having a vertical flange on each side edge, the flanges of the floor sections being fastened together, the floor sections having outer edges that join a lower edge of the outer wall, the floor sections having inner edges that join a lower edge of the inner wall; and wherein the flanges of the floor sections extend upward from the floor sections into the interior of the housing.

5. A housing for a tower for housing telecommunication equipment, comprising in combination:

an annular outer wall having an axis adapted to coincide with a longitudinal axis of the tower, the outer wall being of a material selected to allow the passage of telecommunication signals through the wall from the telecommunication equipment;

an annular inner wall spaced radially inward from the outer wall, the inner wall defining a central opening for receiving the tower;

a floor extending between the inner and outer walls for supporting the telecommunication equipment;

a top extending between the inner and outer walls above the floor;

means at the inner means at the inner wall to the tower; wherein the floor comprises:

a plurality of floor sections extending circumferentially around the housing, each floor section having a vertical flange on each side edge, the flanges of the floor sections being fastened together, the floor sections having outer edges that join a lower edge of the outer wall, the floor sections having inner edges that join a lower edge of the inner wall; and wherein the vertical dimensions of the flanges of the floor sections decrease from the inner edge to the outer edge.

6. A telecommunication equipment housing for mounting to a tower having a plurality of leg members and a longitudinal axis located equidistant between the leg members, comprising in combination:

upper and lower inner rings;

fastening means for securing the inner rings to the leg members vertically spaced apart from each other and with each inner ring surrounding the leg members;

upper and lower outer rings, each outer ring being circular;

a plurality of floor sections extending between the lower inner ring and the lower outer ring and secured together to form a floor;

a plurality of top sections extending between the upper inner ring and the upper outer ring and secured together to form a top;

a plurality of outer wall sections secured together to form an outer wall, each of the outer wall sections having an upper edge secured to the upper outer ring and a lower edge secured to the lower outer ring, the outer wall sections being of a material selected to allow telecommunication signals to pass through from telecommunication equipment located in the housing; and a plurality of inner wall sections secured together to form an inner wall, each inner wall section having an upper edge secured to the upper inner ring and a lower edge secured to the lower inner ring.

7. The housing according to claim 6 wherein each of the outer wall sections is curved outward.

8. The housing according to claim 6 wherein each of the outer wall sections has a inward extending vertical flange on each side edge, the flanges being fastened together to secure the outer walls sections together.

9. The housing according to claim 6 wherein each of the floor sections comprises:

a plate having side edges extending radially from the longitudinal axis of the tower; and a flange extending upward from the plate on each side edge, the flanges being fastened together to secure the floor sections together.

10. The housing according to claim 9 wherein each of the flanges of the floor sections decrease in vertical dimension from the inner edge of each floor section outward.

11. The housing according to claim 6 wherein the upper and lower inner rings are circular.

* * * * *